US006050349A

United States Patent [19]

Rountree et al.

[11] Patent Number: 6,050,349

[45] Date of Patent: Apr. 18, 2000

[54] HYDRAULIC SYSTEM FOR MUD PULSE GENERATION

[75] Inventors: Steven P. Rountree, Lafayette; Joan B. Broussard, St. Martinville; Angelo J. Tamporello, Franklin, all of La.

[73] Assignee: Prime Directional Systems, LLC, Broussard, La.

[21] Appl. No.: 08/951,122

[22] Filed: Oct. 16, 1997

[51] Int. Cl.[7] ..... E21B 44/00; G01V 1/40

[52] U.S. Cl. ..... 175/40; 175/93; 367/83; 340/853.8; 73/744

[58] Field of Search ..... 175/40, 48, 57, 175/93, 107; 340/853.8, 854.4, 854.5; 367/82, 83; 73/744

[56] References Cited

U.S. PATENT DOCUMENTS

| | | | |
|---|---|---|---|
| 3,737,843 | 6/1973 | Le Peuvedic et al. | 340/18 |
| 3,756,076 | 9/1973 | Quichaud et al. | 73/151 |
| 3,964,556 | 6/1976 | Gearhart et al. | 175/45 |
| 3,982,224 | 9/1976 | Patton | 340/18 |
| 4,550,392 | 10/1985 | Mumby | 367/82 |
| 4,557,295 | 12/1985 | Holmes | 137/813 |
| 4,596,293 | 6/1986 | Wallussek et al. | 340/853.8 |
| 4,829,829 | 5/1989 | Ferris | 73/744 |
| 4,932,005 | 6/1990 | Birdwell | 367/83 |
| 5,806,612 | 9/1998 | Vorhoff et al. | 367/83 |

OTHER PUBLICATIONS

Downhole Mud Pulse Telemetry / Bartlesville Energy Technology Center, published prior to Oct. 16, 1996.

Mud Pulse Telemetry Demonstration For Directional Drilling / Final Report For Pilot Demonstration Date Published–Jun. 1979.

Experimental and Theoretical Study of Mud Pulse Propagation. A thesis submitted to the Graduate Faculty of the La. State Univ. & Agric. & Mechanical College in partial fulfillment of the requirements for the degree of Master of Science in Petroleum Engineering by Joseph Alan Carter, B.S., Mississippi State Univ., May, 1986.

*Primary Examiner*—William Neuder

*Attorney, Agent, or Firm*—Roy, Kiesel & Tucker

[57] ABSTRACT

A hydraulic system for supplying hydraulic fluid for operating a mud pulse generator includes an accumulator that has a reservoir. The accumulator is arranged to maintain the fluid pressure in the reservoir. The system also has a pressure operated, one way inlet valve that is arranged to allow hydraulic fluid to be added, under pressure, to the reservoir. The one way inlet valve also includes a valve core.

26 Claims, 13 Drawing Sheets

HYDRAULIC SYSTEM FOR MUD PULSE GENERATION

BACKGROUND OF THE INVENTION

The invention relates to a hydraulic system for mud pulse generation.

One technique used to drill a wellbore involves rotational drilling in which a drill string is rotated to actuate a drill bit at the remote end of the drill string. The rotating bit cuts through subterranean formations opening a path for the drill pipe that follows. Another technique involves using a motor, as opposed to rotating the drill string, to actuate the drill bit. The motor responds to drilling fluid that is forced through a central passageway of the drill string to the motor. The drilling fluid exits the motor and returns to the surface via an annular space, or annulus, that is located between the drill string and the wellbore.

It is usually desirable to obtain information about one or more downhole conditions as drilling progresses. For example, it may be desirable to know the wellbore inclination angle, wellbore magnetic heading and/or the tool-face orientation of the bottom-hole assembly to ensure that drilling is progressing in the right direction. Other useful information includes radioactivity of the formation to discriminate between sands and shale, resistivity and porosity of the formation to determine if oil is present.

These downhole conditions are typically measured by sensors located as near as possible to the bit. A downhole measurement while drilling (MWD) mud pulser transmits these measurements to the surface of the well by modulating the already present stream of drilling fluid that circulates down the central passageway of the drill string and up through the annulus. Sensor measurements are typically encoded in the stream by selectively restricting the flow of drilling fluid. As a result of these restrictions, the encoded data takes on the form of pressure pulses. Sensors at the surface of the well decode these pressure pulses to recover the downhole information from the mud stream.

SUMMARY OF THE INVENTION

In general, in one aspect, the invention features a hydraulic system for supplying hydraulic fluid for operating a mud pulse generator. The hydraulic system includes an accumulator that has a reservoir and a pressure operated, one way inlet valve. The accumulator is arranged to maintain the fluid pressure in the reservoir, and the valve is arranged to allow hydraulic fluid to be added, under pressure, to the reservoir.

Implementations of the invention may include one or more of the following. The one way inlet valve may have a valve core. The hydraulic fluid reservoir may have a fluid pressure accumulator.

In general, in another aspect, the invention features a method for charging a hydraulic system for a mud pulse generator. The method includes supplying hydraulic fluid under pressure through a one way inlet valve to a reservoir of the system.

Implementations of the invention may include one or more of the following. The hydraulic system may be located in a pressure housing of a downhole tool. The method may include submerging the hydraulic system in a tank of hydraulic fluid, applying a vacuum to the fluid to remove air from the hydraulic system, releasing the vacuum and mounting the pressure housing over the hydraulic system while the system remains submerged. The method may include maintaining the hydraulic system in one discrete assembly that is part of a downhole tool that has at least one other discrete assembly. The hydraulic system is charged before the discrete assemblies are connected together.

In general, in another aspect, the invention features a downhole tool for use in a high pressure environment in a subterranean well. The tool includes an accumulator that has a reservoir for storing hydraulic fluid and an actuator that has a shaft with a passageway adapted to establish pressure communication between the reservoir and the high pressure environment.

Implementations of the invention may include one or more of the following. The high pressure environment may include the hydrostatic pressure of a drilling fluid. The downhole tool may include a housing encasing the accumulator and actuator. The tool may also have a gasket that is adapted to form a seal between the housing and the actuator. The communication established by the passageway may minimize a pressure difference across the seaal. The actuator may include a rotary actuator.

In general, in another aspect, the invention features a method for use with a downhole tool that includes an accumulator having a reservoir with hydraulic fluid and a piston having a position indicative of a pressure level of the hydraulic fluid. The method includes determining the position of the piston, and based on the position, determining the pressure level of the hydraulic fluid.

Implementations of the invention may include one or more of the following. The tool may include an actuator that has a shaft with a passageway that is adapted to establish communication between the reservoir and an area surrounding the tool. The step of determining the position of the piston may include from outside of the tool, inserting a rod into the passageway a distance to contact the piston and determining the position based on the distance.

DESCRIPTION OF THE PREFERRED EMBODIMENTS

Figure 1:
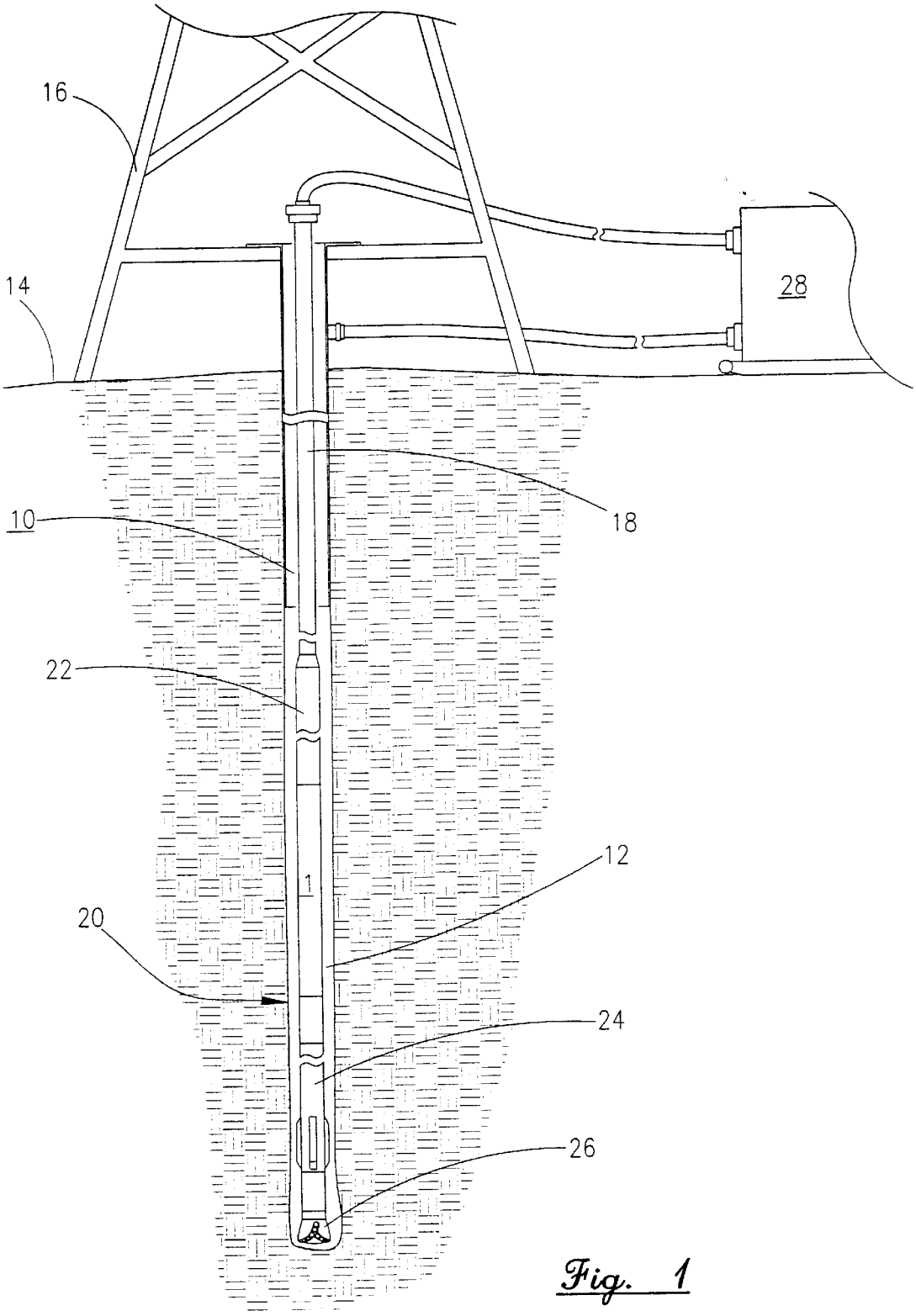
FIG. 1 is a schematic view of a drilling assembly.

Referring to the drawing wherein like reference characters are used for like parts throughout the several views, a drill string 10 (see FIG. 1) is suspended in a wellbore 12 and supported at the surface 14 by a drilling rig 16. The drill string 10 includes a drill pipe 18 coupled to a downhole tool assembly 20. The downhole tool assembly 20 includes multiple (e.g., twenty) drill collars 22, a measurement-while-drilling (MWD) tool assembly 1, a mud motor 24, and a drill bit 26. The drill collars 22 are connected to the drill string 10 on the uphole end of the drill collars 22, and the uphole end of the MWD tool assembly 1 is connected to the downhole end of the drill collars 22. The uphole end of the mud motor 24 is connected to the downhole end of MWD tool assembly 1. The downhole end of the mud motor 24 is connected to drill bit 26.

The drill bit 26 is rotated by the mud motor 24 which responds to the flow of drilling fluid, or mud, which is pumped from a mud tank 28 through a central passageway of the drill pipe 18, drill collars 22, MWD tool assembly 1 and then to the mud motor 24. The pumped drilling fluid jets out of the drill bit 26 and flows back to the surface through an annular region, or annulus, between the drill string 10 and the wellbore 12. The drilling fluid carries debris away from the drill bit 26 as the drilling fluid flows back to the surface. Shakers and other filters remove the debris from the drilling fluid before the drilling fluid is recirculated downhole.

The drill collars 22 provide a means to set weight off on the drill bit 26, enabling the drill bit 26 to crush and cut the formations as the mud motor 24 rotates the drill bit 26. As drilling progresses, there is a need to monitor various downhole conditions. To accomplish this, the MWD tool assembly 1 measures and stores downhole parameters and formation characteristics for transmission to the surface using the circulating column of drilling fluid. The downhole information is transmitted to the surface via encoded pressure pulses in the circulating column of drilling fluid.

Figure 2:
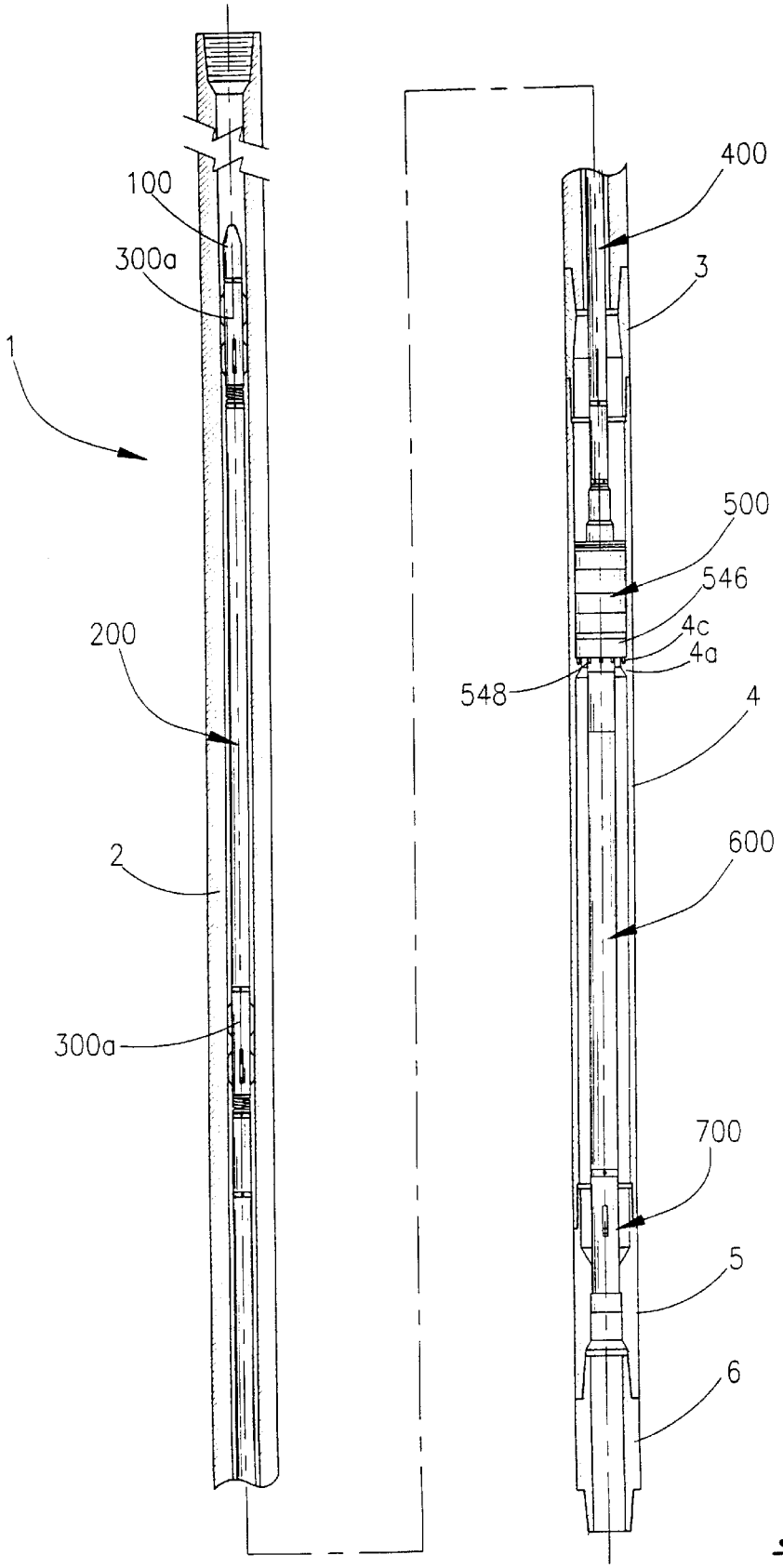
FIG. 2 is a vertical cross-sectional view of a portion of the drilling assembly of FIG. 1.

Referring to FIG. 2, from top to bottom, the components housed within the MWD tool assembly 1 include a bull plug 100, an upper rubber fin centralizer 300*a*, a survey measurement assembly 200, a lower rubber fin centralizer 300*b*, an interface assembly 400, a turbine assembly 500, an actuator assembly 600 and a valve assembly 700.

The bull plug 100 diverts the drilling fluid and protects the upper end of upper rubber fin centralizer 300*a*. The rubber fin centralizers 300*a* and 300*b* coaxially center the survey measurement assembly 200 and the interface assembly 400 that are housed within non-magnetic drill collar 2.

The survey measurement assembly 200 may include, for example, survey sensors, a microprocessor, microprocessor control program, and such additional supporting electrical circuitry (not shown) for producing electrical signals representative of downhole information that may be of interest. These electrical signals, via the interface assembly 400, control a spool valve 647 (see FIG. 5) within the actuator assembly 600. The spool valve 647 controls the flow of hydraulic fluid to a rotary actuator 657, which in turn, controls a valve sleeve 703. (See FIG. 7).

Figure 7:
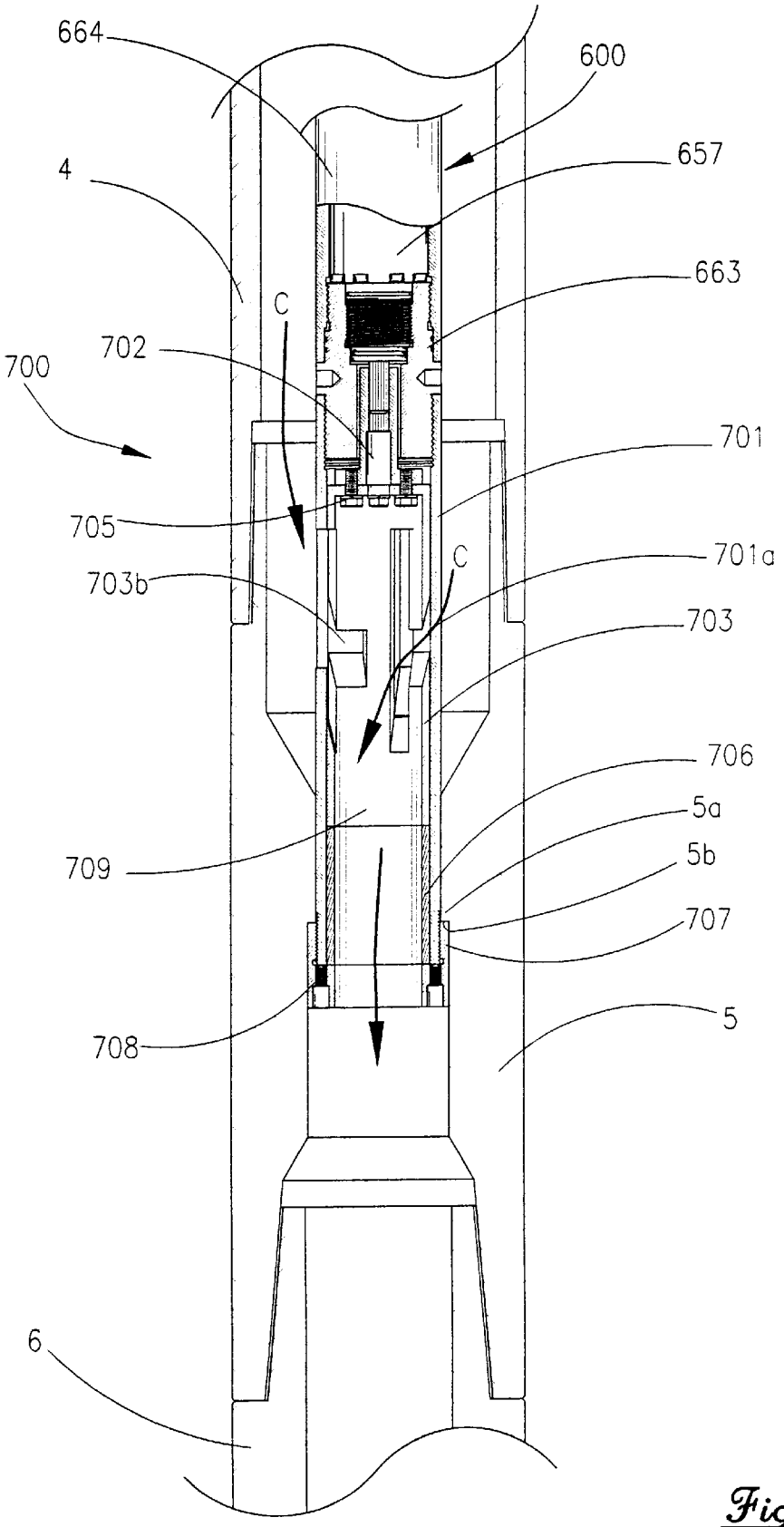
FIG. 7 is a vertical schematic view of the mud valve assembly of FIG. 1.

Referring to FIG. 7, the valve sleeve 703 may be shifted between positions of low resistance (referred to as the open position) and high resistance (referred to as the close position, though not totally restricting the flow) to the flow of the drilling fluid. Shifting the valve sleeve 703 from an open position to a closed position and then back to an open position generates a momentary pressure increase, or pressure pulse, which is detectable on the surface with a pressure sensor. Detected pressure pulses may be decoded in order to reconstruct the information of interest. Thus, in response to the electrical signals generate by the survey measurement assembly 200, pressure pulses are generated in the drilling fluid corresponding to the information of interest and the sequence of pressure pulses carries this information which is recoverable at the surface.

Referring back to FIG. 2, circuitry within the interface assembly 400 rectifies and regulates the three phase AC output of alternator 625. The regulated power is distributed to the survey measurement assembly 200 and the actuator assembly 600.

Figure 3:
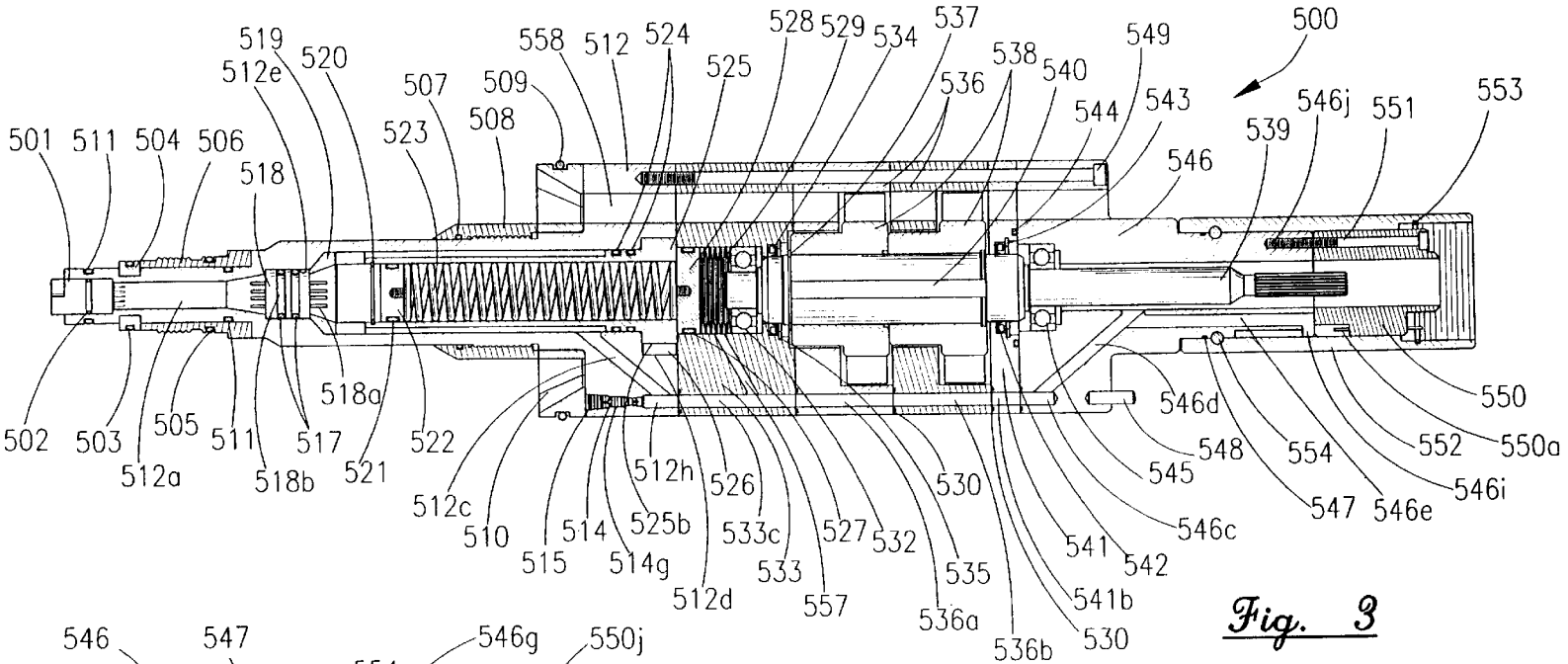
FIGS. 3 and 3A are schematic views of a turbine assembly of the drilling assembly of FIG. 1.

Drilling fluid flows through the drill string 10 and past the stabilizer 300*a*, the survey measurement assembly 200, the stabilizer 300*b*, the interface assembly 400, and then, into the inlet ports 510 (see FIG. 3) of the turbine assembly 500. Referring to FIG. 3, as the drilling fluid flows past the turbine rotors 538 the drilling fluid exerts a force on the turbine rotors 538 which causes a rotation of a drive shaft 539. The drive shaft 539, which is mechanically coupled to the actuator assembly 600, provides mechanical power to drive the alternator 625 and a hydraulic pump 634 (see FIG. 5). Electrical power provided by the alternator 625 powers the electrically systems, and hydraulic power provided by the hydraulic pump 634 powers the rotary actuator 657 which opens and closes the valve 700.

More detailed descriptions of components of the MWD assembly 1, such as a printed circuit board assembly 202, the turbine assembly 500, the actuator assembly 600, the valve assembly 700, and the connectors 550 and 608 are found below in the respective sections.

Turbine Assembly

Figure 4:
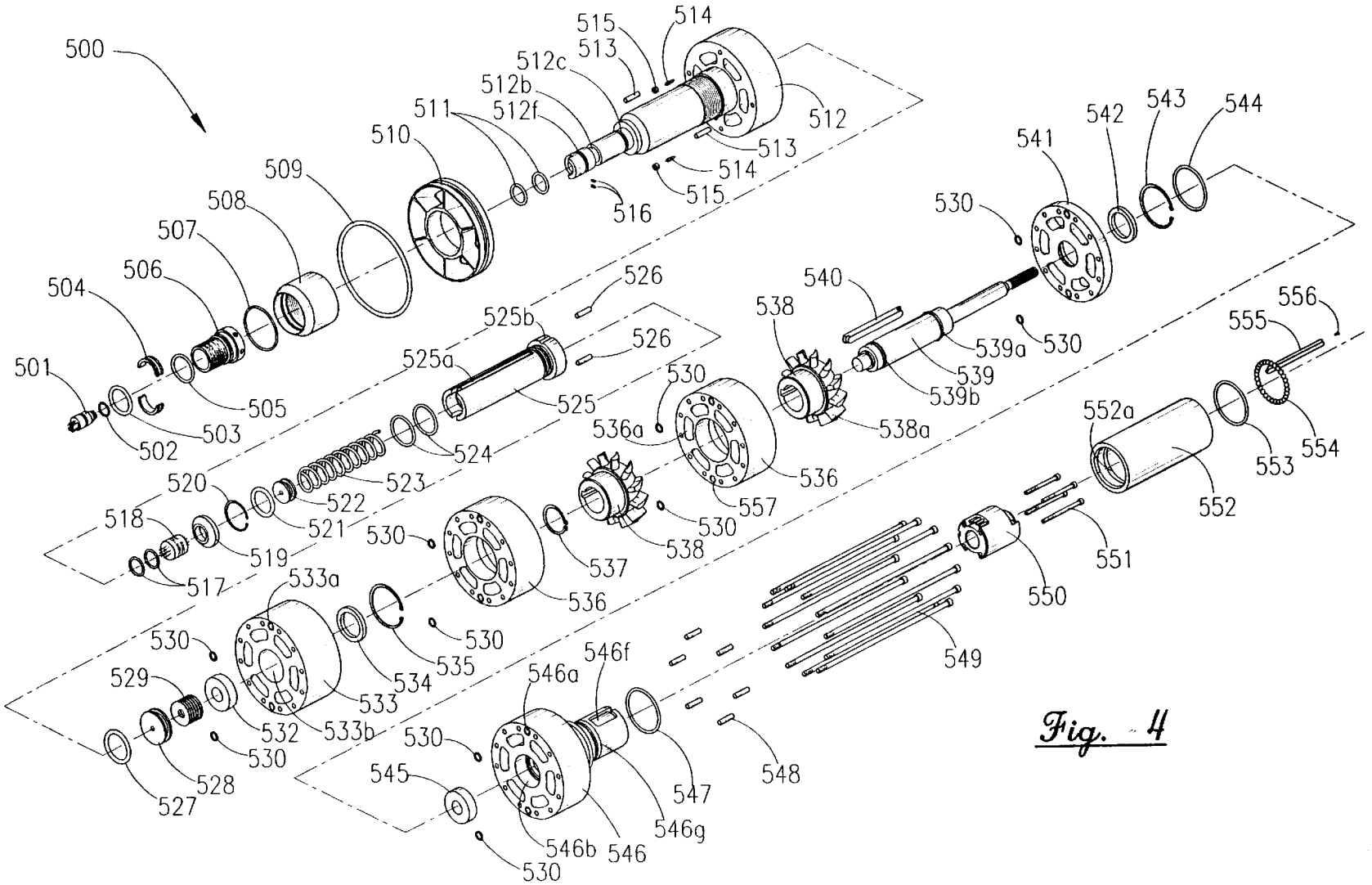
FIG. 4 is an exploded perspective view of the turbine assembly of FIG. 3.

Referring to FIGS. 3 and 4, the turbine assembly 500 is the system prime mover; that is, the turbine provides the rotary power to drive the alternator 625 and the hydraulic pump 634. The turbine assembly 500 is mechanically and electrically coupled and keyed to the actuator assembly 600.

The assembly of the turbine assembly 500 begins with the installation of a feed-through connector 518. Wires are soldered to both ends of feed-through conductors on the connector 518, the two O-rings 517 are installed in the O-ring grooves 518*a* on the body of connector 518, and then the connector 518 is installed in a weldment 512. In the course of installing the connector 518, the wires on the top side of connector 518 are fed from the lower end of the weldment 512 through a hole 512*a* in the center of weldment 512 up to and through the upper end of weldment 512. The connector 518 is seated in gland 512*e*, and the wires on the up-hole side are trimmed and soldered to connector 501. The O-ring 502 is installed on the outside of the connector 501, and the wires are folded and stuffed into the upper end of weldment 512 as the connector 501 is installed in the upper end of weldment 512.

The connector 501 is keyed to the upper end of weldment 512 by set screws 516. The connector 518 is a high pressure, high temperature connector designed to protect connector 501 and the balance of the electronics installed above connector 501. The connector 518 is held in place by the interference between the body of connector 518 and tapered ring 519. The tapered ring 519 is, in turn, held in place by accumulator housing 525.

The interface assembly 400 is connected to the top end of the weldment 512 via threaded nut 506. One of the two O-rings 511 is installed in O-ring gland 512*c* on the upper end of the weldment 512, and nut 506 slipped onto the upper end of the weldment 512. The two half-shells 504, which are installed in groove 512*b* and held together by O-ring 503, hold the nut 506 in place on the weldment 512. The second of the two O-rings 511 and O-ring 505 are installed in conjunction with the installation of the rubber fin centralizer 300*b*.

The drilling fluid is directed through the turbine assembly 500 via a diverter 510 which slides over the upper end of weldment 512. The diverter 510 is keyed in place with dowel pins 513 and held in place on top of the weldment 512 by a nut 508. The O-ring 507 is installed in an interior gland of nut 508, and the nut 508 slides over the upper end of weldment 512 and is threadedly attached to the weldment 512. The O-ring 507 keeps debris out of the threaded area below the O-ring 507. The drilling fluid may be extremely abrasive and diverter 510 is a disposable part that absorbs the wear caused by the incoming drilling fluid.

The turbine accumulator includes elements 521, 522, 523, 524 and 525. The turbine accumulator provides a means to maintain a net positive pressure, with respect to the hydrostatic pressure of the column of drilling fluid, in the interior cavities of the turbine. The snap ring 520, which is installed in an interior groove of accumulator housing 525, is a means to stop the upward displacement of piston 522. The two O-rings 524 are installed in the two O-ring grooves on the lower end of housing 525, and the accumulator housing 525 slides into the cavity within 512 from the lower end.

The wires on the lower side of feed-through connector 518 are fed down through the cavity within the weldment and into cross holes 512*c* as shown in FIG. 4. As housing 525 slides into place the wires running from connector 518 are worked into the grooves 525*a* running along the outside of 525. The relative alignment of the grooves 525*a* and the cross holes 512*c* is maintain by dowel pins 526 which engage the slots 525*b* on the accumulator and slots 512*d* on the weldment. After this assembly has been completed, the wires on the lower side of connector 518 run laterally down to the top of grooves 525*a*, along side the accumulator housing in grooves 525*a* and into the cross holes 512*c*. The accumulator housing 525 holds tapered ring 519 and connector 518 in place via the interference of the parts. The accumulator housing 525 is, in turn, held in place by the interference between housing 525 and the upper bearing housing 533.

The upper end of shaft 539 is secured by bearing 532 which is seated in upper bearing housing 533. The housing 533 surrounds the bearing 532, disc springs 529 (that go in on top of the bearing 532), the piston 528 and an O-ring 527. The O-ring 527 goes in the O-ring groove on piston 528 and slides into the opening 533*b* of housing 533. On each side of the housing 533, near the outer edge, are two O-ring glands 533*a*. An O-ring 530 fits in each of these glands 533*a*. The glands 533*a* are associated with the conduit 557 that extends through the turbine assembly 500 to provide the means to run wires from connector 518 to connector 550. On the underside of 533 is a gland for shaft seal 534. Seal 534 is a lip seal which may be encapsulated in a stainless steel housing. Seal 534 is held in place by snap ring 535. The seal 534 seals the passage between the housing 533 and the shaft 539.

Below the upper bearing housing 533 are two turbine stators 536 and two turbine rotors 538. The rotors 538 are keyed to shaft 539 via key 540. The bottom rotor slides over the upper end of shaft 539 and shoulders up on the raised area 539*a* on shaft 539. The turbine stack is assembled by sliding the lower rotor 538 onto the shaft 539 from the upper end of the shaft 539 and then sliding the lower stator 536 over the lower rotor 538 from the upper end of shaft 539. Next, the upper rotor 538 slides onto the shaft 539 from the upper end of shaft 539 and is axially fixed in position by a snap ring 537. The rotors are axially positioned on shaft 539 between the raised area on the area 539*a* on the shaft 539 and the snap ring 537 located in snap ring groove 539*b*. Then the upper stator 536 slides over the upper rotor 538 from the upper end of shaft 539.

Each rotor 538 has evenly spaced fins 538*a* that are circumferentially located on the body of the rotor 538. Each stator 536 of the turbine assembly has evenly space ports that are circumferentially arranged about the stator. The passages through the stator are ports that run axially along the body of the stator while the passages through the rotor fins are defined by "cupped" blades. In traditional turbine design, the fins on both the rotor and stator are "cupped," and more specifically, they are "cupped" in the opposite direction. The rotors and stators of the traditional design are manufactured in a casting process which is burdened by large financial investment in the castings. Unlike traditional designs, by making the ports through the stator straight while maintaining a "cupped" profile for the rotor blades, the rotor and stator can both manufacture in small volume at a significantly reduced cost.

Below the lower turbine stator is a seal plate 541. On the underside of the seal plate 541 is a gland for shaft seal 542. The seal 542 is a lip seal which may be encapsulated in a stainless steel housing. The seal 542 is held in place by snap ring 543. The seal 542 seals the passage between the seal plate 541 and the shaft 539. The O-ring 544 seal is one of several seals that is employed to seal the internal cavity of the turbine assembly 500.

The lower weldment 546 features a means to secure the lower end of shaft 539, porting through the weldment 546 for wireways, means to key the turbine assembly to the pulser collar 4, and means to couple, electrically and mechanically, the turbine assembly 500 and the actuator assembly 600. The porting through weldment 546 includes O-ring glands 546*a* and ports 546*c* which extend axially down to intersect a diagonally drilled hole 546*d*, shown in FIG. 3, which extends axially downwardly and radially inwardly to intersect drilled holes 546*e*. Drilled holes 546*e* extend from the intersection with 546*d* to the lower end of the weldment 546. The weldment 546 is made up of two pieces to form the diagonal hole through the part.

The turbine assembly components, upper weldment 512, bearing housing 533, two stators 536, seal plate 541 and lower weldment 546 are held together by the cap screws 549. An advantage of this segmented assembly is that the bolts hold the assembly together so the assembly can be removed as a unit. The drilled hole wireways through the components are aligned with respect to one another and wires are fished through the wireways. As the components are brought together the upper end of shaft 539 engages seal 534 and bearing 532. Seal plate 541 and lower weldment 546 slide over the lower end of shaft 539, and seal 542 and bearing 545 engage the shaft 539 just below the raised area 539*a*. The bolts 549 hold together the upper weldment 512, lower weldment 546 and all of the intervening components. The bolts 549 go through the lower weldment 546 and through the seal plate 541, the two stators 536 and the upper bearing housing 533, and the bolts 549 are threadedly anchored in the upper weldment 512.

The wires which are pulled through the wireway porting in the course of assembling the turbine assembly are cut to length and soldered to the terminals on the connector 550. The connector 550 is attached to the lower end of weldment 546 with bolts 551, and the excess wire is folded over into pockets 546f of the lower weldment 546 and a potting material is used to secure the wires in the pockets 546*f*.

Figure 3A:
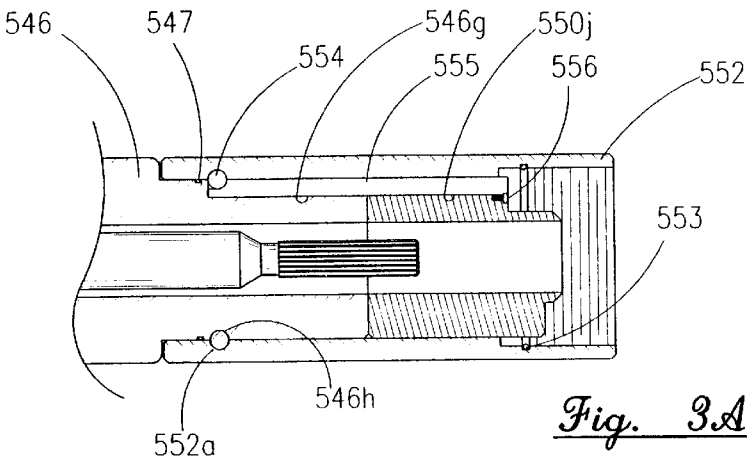

Referring to FIG. 3A, the sleeve 552 provides the means to mechanically attach the turbine assembly 600 to the actuator assembly 500. O-ring 547 is installed and sleeve 552 is slipped over the lower end of the weldment 546. The sleeve 552 is held in place by balls 554. A passage 550*j* along the side of connector 550 and a passage 546*g* along the lower end of the weldment 546 provides the means to load the balls 554 in the cavity formed by inner ball race 546*h* and outer ball race 552*a*. To load the balls, the turbine assembly is turned upside down and tilted slightly. The balls are dropped through the passages 550*j* and 546*g*, and the balls fall through the passages 550*j* and 546*g* into the cavity formed by inner ball race 546*h* and outer ball race 552*a*. The balls are held in place by a keeper 555 which is inserted into the passages 550*j* and 546*g*. Keeper 555 is in turn held in place by a screw 556. O-ring 553 is installed in an interior gland on sleeve 552 and provides a means to seal the passage between the threaded end of the sleeve 552 and the upper, threaded end of pressure housing 664.

The turbine assembly 600 includes conduits through which electrical wires extend through the assembly 600. A conduit 557 extends from the upper end of weldment 512 down through the center of 512, along the outside of 525 in the cavity formed by groove 525*a*, through the diagonally drilled hole 512*c*, axially through each of the components 533, 536, and 541, through the diagonally drilled hole 546*d*, axially through the drilled hole 546*e*, and radially through port 546*i*. This conduit 557 provides the means to run electrical wires from connector 501 to connector 550.

The electrical wiring through the turbine assembly provides the means to power the electronics located above the turbine assembly 500 with the alternator 625 which is located below the turbine assembly 500 in the actuator assembly 600. The electrical wiring through the turbine assembly 500 also provides the means to control the power to the solenoids within the spool valve 647. The spool valve 647 in turn controls the position, either open or closed, of the mud valve.

The lower weldment 546 rests on an inner, annular shelf 4*a* inside the pulser collar 4 (see FIG. 2). To key the turbine assembly 500 inside the pulser collar 4, the dowel pins 548 of the lower weldment 546 are configured to align with mating ports 4*c* (see FIG. 15) that are formed in the shelf 4*a*.

Actuator Assembly

The actuator assembly 600 provides hydraulic power to operate the mud valve and also provides electrical power to the electronics. Actuator assembly 600 connects to the turbine assembly 500 which provides the rotary power to drive the alternator 625 and the hydraulic pump 634.

Figure 5:
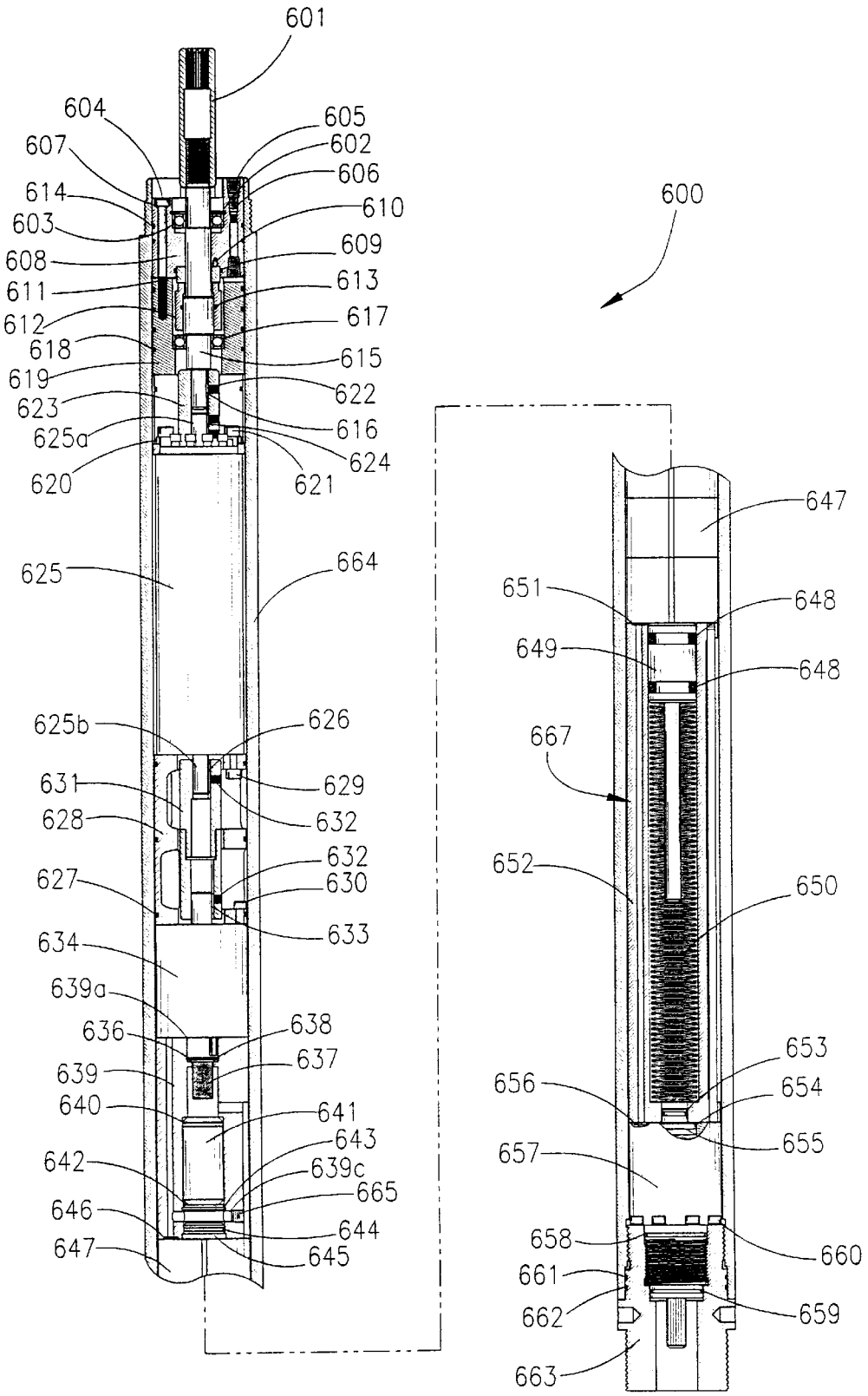
FIG. 5 is a vertical cross-sectional view of the actuator assembly of the drilling assembly of FIG. 1.
Figure 6:
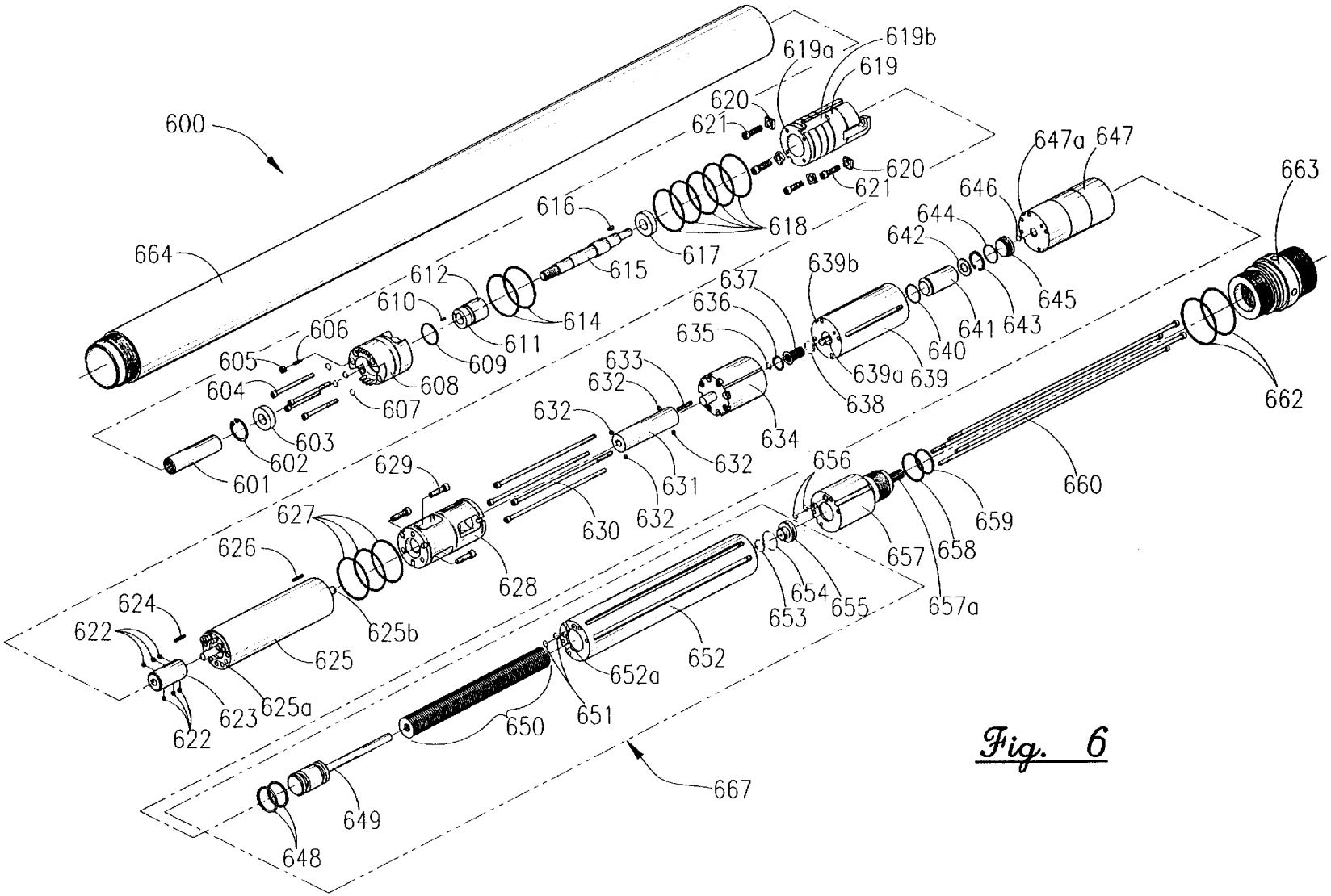
FIG. 6 is an exploded perspective view of the actuator assembly of FIG. 5.

Referring to FIGS. 5 and 6, a sub-assembly of the assembly 600 includes components 602 through 619 that provide a means to seal the upper end of actuator assembly 600 within pressure housing 664. This sub-assembly also provides the means to electrically connect alternator 625 and solenoid valve 647 to connector 550 on the lower end of turbine 500 and to mechanically couple alternator 625 and hydraulic pump 634 to drive shaft 539 of turbine assembly 500.

The bearing 603 is installed in the top of connector 608 and held in place by a snap ring 602. An O-ring 609 and a dowel pin 610 are installed in the lower end of the connector 608 and the non-rotating portion of the face seal 612 is inserted in the lower end of the connector 608. The O-ring 609 seals the passage between the connector and the non-rotating portion of the face seal 612. The rotating portion of the face seal 612 slides over the upper end of shaft 615 and is held in place by set screws (not shown). The O-ring 613 within the face seal 612 seals the passage between the face seal 612 and the shaft 615. Lower bearing 617 slides over the lower end of shaft 615, and shaft 615 is held in place via the opposed bearing 603 by securing bracket 619 to connector 608 with cap screws 604. Cap screws 604 run through the O-rings 607 and are anchored in threaded holes 619*a* in bracket 619. O-rings 607 seal the passage between cap screws 604 and connector 609.

The coupling 601 provides the means to couple shaft 615 to turbine shaft 539. The coupling 601 is threadedly attached to the upper end of shaft 615. In the course of attaching the turbine assembly 500 to the actuator assembly 600, the splined (external spline) end of shaft 539 engages the splined (internal spline) end of coupling 601.

The coupling 623, keys 616 and 624, and set screws 622 provide the means to couple shaft 615 to alternator shaft 625*a*. Coupling 623 is installed on shaft 615 and bracket 619 is secured to alternator 625 with cap screws 621 and washers 620. Set screws 622 secure the coupling 623 to shaft 615 and alternator shaft 625*a*.

Bracket 628, keys 626 and 633, and coupling 631 provide the means to couple hydraulic pump 634 to the alternator 625. The coupling 631 is secured to the shaft 625*b* via set screws 632 installed in the upper end of coupling 631, and bracket 628 is attached to the lower end of alternator 625 by means of cap screws 629. Set screws 632 installed in the lower end of coupling 631 secure coupling 631 to the shaft of the hydraulic pump 634.

The bracket 639 provide the means to secure the hydraulic pump 634 to spool valve 647. The bracket 639 also houses a relief valve 641 and strainer 637. The O-ring 638 and strainer 637 are installed in port 639*a* and secured in place with snap ring 636. O-ring 640 is installed on the relief valve 641, and the relief valve 641 is installed in bracket 639 from the lower end of the bracket 639. The relief valve is held in place by washer 642 and snap ring 643. The port through which the relief is installed is sealed off by plug 645 and O-ring 644. Post 641*a* is sealed with an expanded plug 665. The bracket 628, pump 634, bracket 639 and spool valve 647 are held together by cap screws 630. O-rings 635 and 646 are installed along the high pressure conduits through bracket 639 and spool valve 647 to maintain the integrity of the fluid flow to the spool valve.

An accumulator 664 is formed from O-rings 648, piston 649, disc springs 650 and a bracket 652. The accumulator provides the means to store within the actuator assembly 600 a small reserve volume of fluid and to offset the hydrostatic pressure due to the column of fluid in the drill string 10. O-rings 648 are install on piston 649, and the disc springs 650 and piston 649 are inserted in bracket 652. Grooves 652*a* in the upper end of bracket 652 provide the means for hydraulic communications across the end of the bracket 652.

The rotary actuator 657 and bracket 652 are secured to spool valve 647 with cap screws 660. Plug 655 and O-rings 651, 653, 654 and 656 are installed in the course of attaching bracket 652 and rotary actuator 657 to spool valve 647. O-rings 651 and 656 seal the fluid paths between the spool valve 647 and rotary actuator 657. O-ring 653 seals the passage between bracket 652 and plug 655, and O-ring 654 seals the passage between rotary actuator 657 and plug 655.

O-rings 658 and 659 are installed on the lower end of rotary actuator 657, and lug 663 is threaded onto the lower end of rotary actuator 657. O-rings 658 and 659 seal the passage between the lug 663 and rotary actuator 657.

O-rings 614 and 662 are installed in conjunction with the installation of the pressure housing 664. The actuator assembly 600, less the pressure housing 664, is placed in a horizontal tank fill with hydraulic fluid. Via the coupling 601, the alternator 625 and hydraulic pump 634 are rotationally driven in order to functionally check the system and to chase the air out of the hydraulic system. After removing the air from the hydraulic lines in the assembly, the assembly is removed from the horizontal tank and lowered into a vertical tank filled with hydraulic fluid and the tank is sealed. A vacuum is pulled on the tank in an effort to remove any addition trapped air. A predetermined vacuum level (e.g., a 28 inch vacuum) is held on the tank for a predetermined duration (e.g., 15 to 20 minutes), and then the vacuum is released. With the actuator assembly remaining submerged in the vertical tank, the pressure housing 664 is slipped over the actuator assembly and threaded onto lug 663. The actuator assembly 600 is then removed from the vertical and the valve core 606 is installed.

The accumulator 664 is charged with hydraulic fluid in the final stages of preparing the tool for use. Externally, a hydraulic pump is attached to the connector 608 via a port 608*a*, and hydraulic fluid is pumped into the system, charging the system to a nominal pressure of, for example, 250 psi. In the process of charging the system, piston 649 is moved downwardly compressing springs 650. After charging the actuator assembly 600, the charging apparatus is removed, and valve core 606 checks the back flow of hydraulic fluid until plug 605 is installed in connector 608. The top of plug 605 is flush with the surface so that it does not interfere with the make up of the connectors 608 and 550.

A hole through the shaft 657*a* of rotary actuator 657 and through plug 655 provides 1) the means to check the charge on the accumulator and 2) the means to communicate the hydrostatic pressure due to the drilling fluid to the interior of bracket 652. A rod inserted through shaft 657 facilitates a measurement of the location of piston 649 with respect to an external reference such as, for example, the lower end of lug 663. With regard to the second function, hydraulic communication between the drilling fluid on the outside of the actuator assembly 600 and the hydraulic fluid on the inside of the actuator assembly 600 provides the means to limit the pressure across the rotary actuator shaft seal (not shown) and the O-ring seals 607, 609, 613, 614, 658, 659, 661 and 662 to a pressure which is no greater that the accumulator charge. That balance is established by movement of piston 649.

Four grooves on brackets 652 and 639 are bolt passageways. This grooved structure reduces the need for deep hole drilling, thus enhancing the manufacturing process.

The slots 647*a* and 639*b* form a flow path for the circulating hydraulics fluid and a wire conduit for the wires that connect the solenoids of valve 647 to the connector 608.

Wires extend from spool valve 647 to the connector 508 and extend from the alternator 625 to the connector 508. To take slack in the wires, the wire runs along side of the bracket 619 and is folded into the pocket 619*b* and held in place by O-rings 618. Similarly, wires that run along side of the bracket 628 are held in place by O-rings 627.

Mud Valve Assembly

Figure 8A:
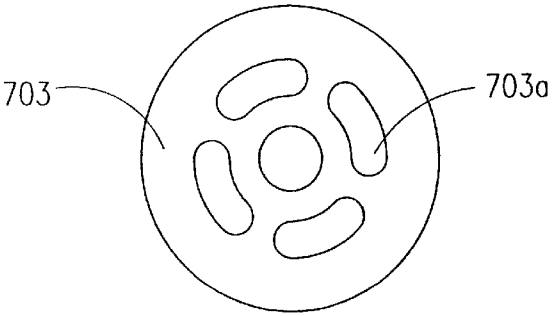
FIG. 8A is and end view of the inner sleeve of FIG. 8.
Figure 8:
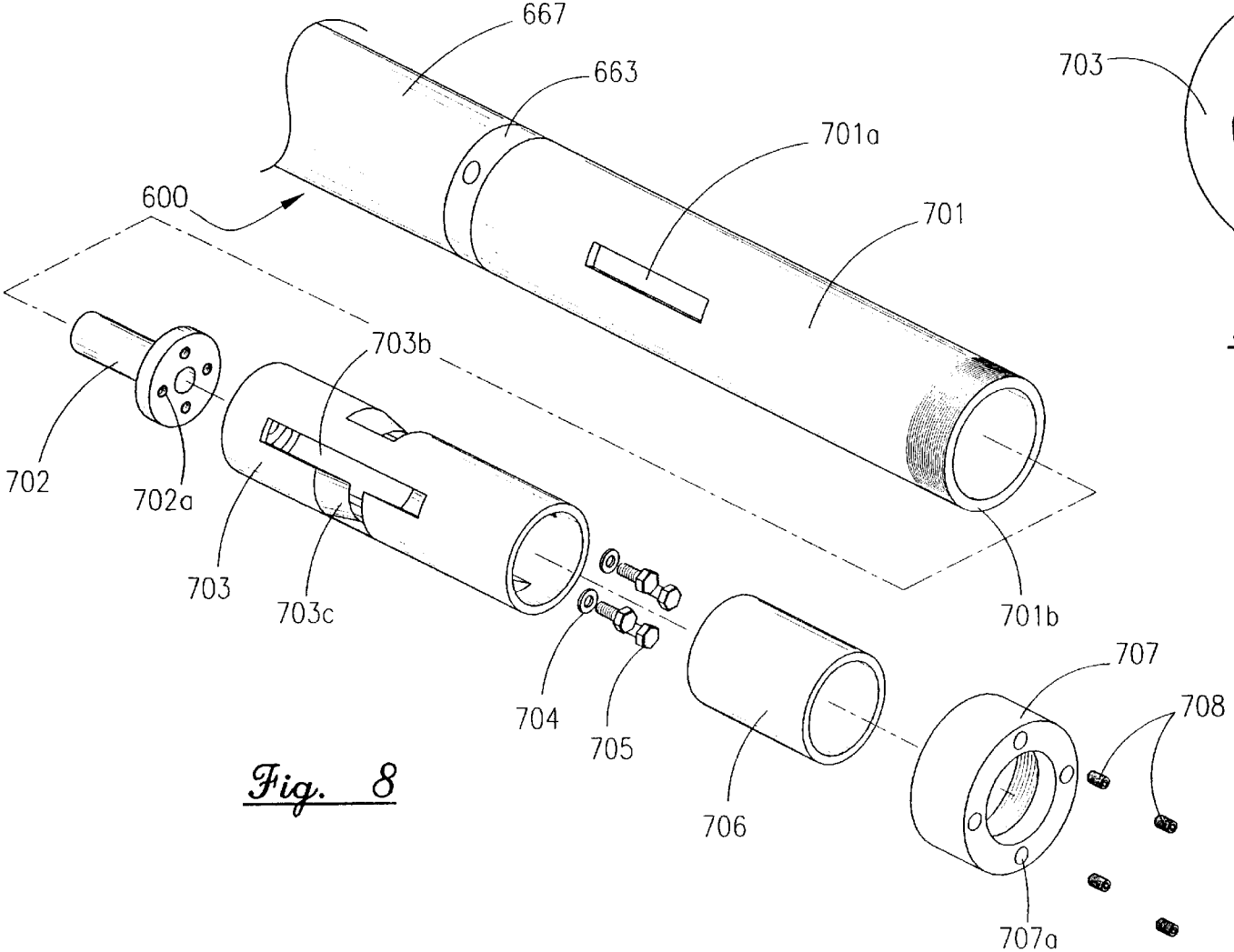
FIG. 8 is an exploded perspective view of a portion of the mud valve assembly of FIG. 7.

Referring to FIGS. 7 and 8, the lower end of a lug 663 receives the outer sleeve 701 of a mud valve 700. The inner sleeve 703 is attached to an actuator coupling 702 with hex head bolts 705 and lock washers 704 which are secured in threaded holes 702*b*. The splined coupling 702 engages the splined end 657*a* of actuator shaft 657 and provides the means to roughly align the flow slots 703*b* of the inner sleeve with the flow slots 701*a* of the outer sleeve. Slots 703*a* (see FIG. 8A), in the upper end of inner sleeve 703 provide the means for a precise alignment of slots 703*b* of the inner sleeve with respect to the slot 701*a* of the outer sleeve. As a matter of practice, the adjustment of the inner sleeve 703 with respect to the outer sleeve 701 takes place after outer sleeve 701 has been made up to the actuator assembly 600 and the turbine assembly 500 and actuator assembly 600 have been coupled together and installed in the pulser collar 4. After this adjustment has been completed, then valve collar 5 is made up to pulser collar 4. The inner valve sleeve 703 and spacer sleeve 706 held inside 701 by nut 707. Spacer sleeve 706 maintains the axial alignment of inner sleeve slots 703*b* with respect to the outer sleeve slots 701*a*. The nut 707 also secures the pulser assembly within pulser collar 300. Set screws 708 are installed in threaded holes 707*a* and pulled down against the end 701*b* of outer sleeve 701. The set screws 708 prevent nut 707 from backing off while tool assembly 1 is in service.

FIG. 8 is a section view of the mud valve. The primary components of the mud valve assembly are outer sleeve 701, inner sleeve 703, and valve collar 5. Drilling fluid flow proceeds downstream from the turbine assembly 500 through the annular passage between the outer wall of the actuator assembly 600 and the inner wall of the pulser collar 4. With slots 701*a* and 703*b* aligned the drilling fluid is flows radially inwardly, as indicated by the arrow C in FIG. 7, into the central axial flow passage 709 and down through the internal passage within 5 to the mud motor and out the bit.

Mud flow through the turbine assembly 500 provides rotary power to drive the actuator assembly 600, and in turn, the actuator assembly 600 provide the means to rotate the shaft 657*a* of rotary actuator 657. Rotation of shaft 657*a* causes the inner sleeve 703 of valve assembly 700 to rotation the small openings 703*c* of inner sleeve into alignment with slots 701*a* of the outer sleeve. This valve position is referred to as the closed valve position. In the closed position, the flow area through the valve is decreased, and thus, the pressure drop across the valve is increased. The actuator assembly 600 also provides the means to rotate the inner sleeve back to the original position, which is referred to as the open valve position, where inner sleeve slots 701*a* are aligned with the outer sleeve slots 703*b*.

A microprocessor within instrument package 200 makes measurements of parameters of interest and encodes those measurements as a sequence of valve positions. The mud valve may be closed and subsequently open after, for example, 1 second to create a pressure pulse which is transmitted through the continuous column of drilling fluid within the drill string. The sequence of valve positions, and thus, the pressure pulses, is correlated to the encoded measurements. At the surface the pressure pulses may be detected and decoded to obtain the measured valves of the parameters of interest.

Hydraulic Circuit

Figure 9:
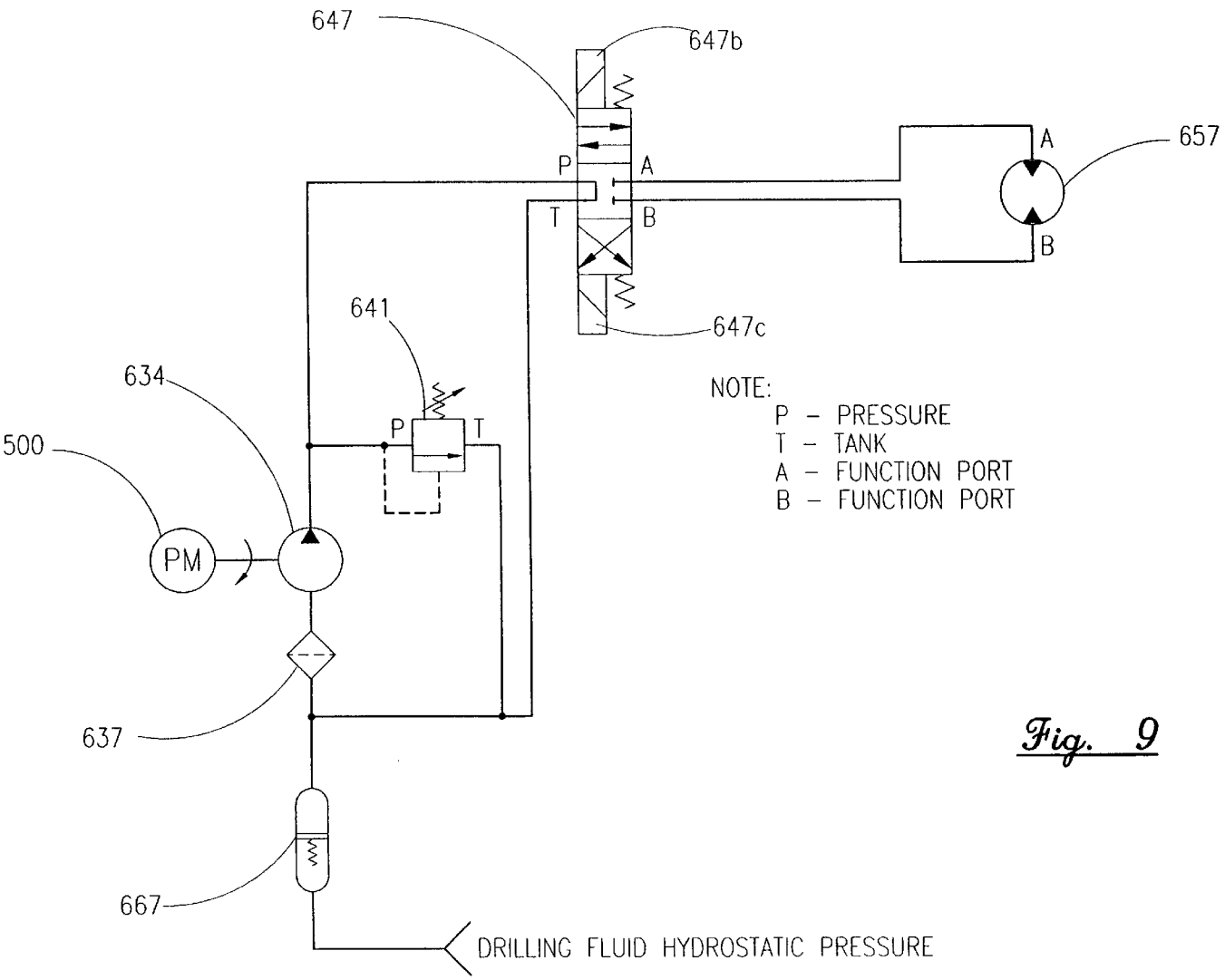
FIG. 9 is a hydraulic diagram of the downhole tool assembly.

Referring to FIG. 9, the hydraulics equipment incorporated into the actuator assembly 600 provides the means to operate mud valve 700. The prime mover PM, which in this case is the turbine assembly 500, drives hydraulic pump 634. Fluid leaving the pump 634 flows to the spool valve 647 or the relief valve 641. Spool valve 647 is a four-way, three position tandem valve. With neither solenoid actuated the spool is centered with P ported to T. With solenoid 647*b* actuated the spool is shifted to connect P to A and B to T. In this configuration, fluid flows from the hydraulic pump 634 through the spool valve 647 to the A port of the rotary actuator 657 and thus, shifts the position of rotary actuator 657. As the rotary actuator 657 reaches the rotational extreme, the fluid flow to A ceases, line pressure builds, the relief valve opens at a predetermined pressure (i.e., 600 psi), and fluid flows across relief valve 641. As the vanes within the rotary actuator 657 shift positions, fluid flows out of the B port to T and back to the inlet of the pump through strainer 637. With solenoid 647*c* actuated the spool is shifted to connect P to B and A to T. Fluid flows from hydraulic pump 634 to the B port of the rotary actuator 657 and shifts the rotary actuator 657 in the opposite direction. As the rotary actuator 657 reaches the rotational extreme the fluid flow to B ceases and fluid flows across relief valve 641. As fluid flows into port B, fluid flows out of port A to T and back to the inlet of hydraulic pump 634 through strainer 637. Accumulator 664 provides the means to maintain a small net pressure, with respect to hydrostatic pressure of the column of drilling fluid, on the actuator assembly 600. The pressure compensation afforded by the accumulator provides an assurance that the pressure across the O-ring seals 607, 609, 613, 614, 658, 659, 661 and 662 and the shaft seals (not shown) within rotary actuator 657 do not exceed the initial charge pressure of the accumulator. Hydraulic fluid stored within the accumulator 664 serves as a small reserve volume of fluid to compensate for small fluid losses across the seals, particularly the face seal 612.

Connector Assembly

Figure 10:
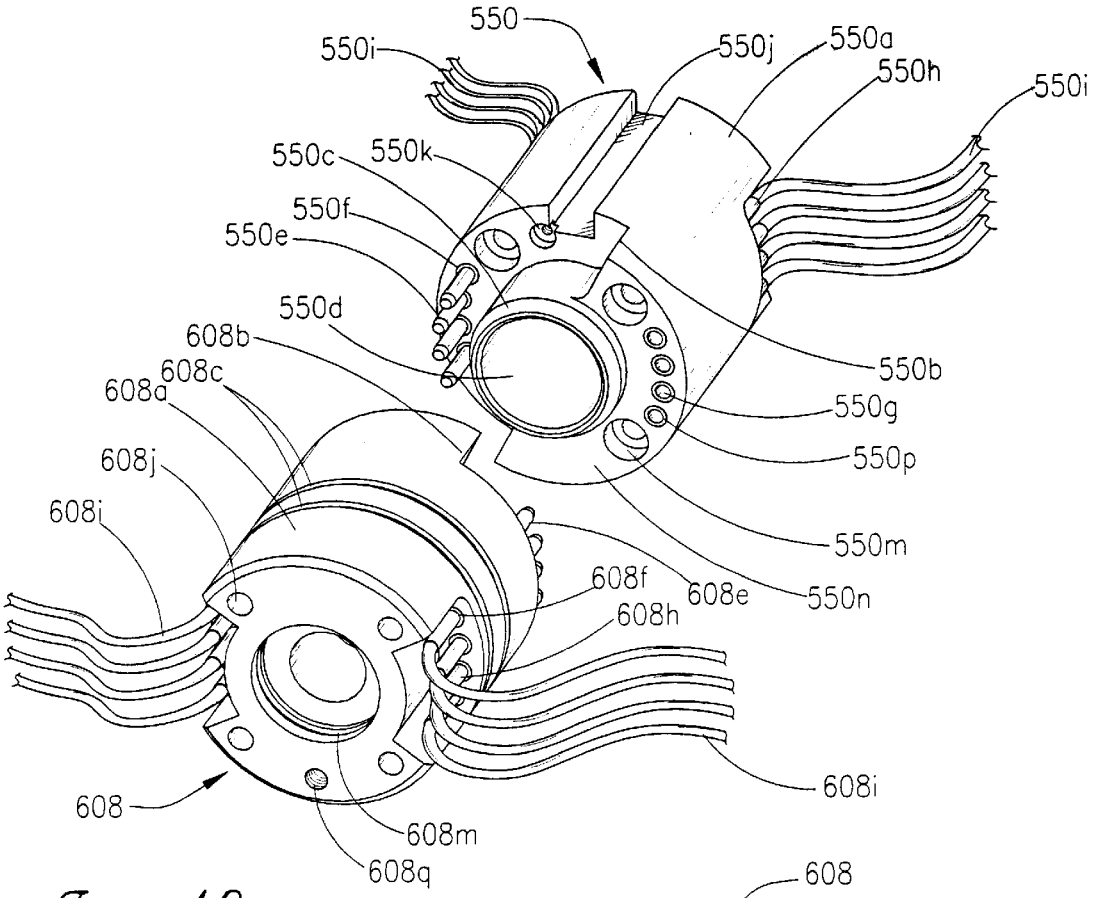
FIGS. 10 and 11 are perspective views of the connectors.
Figure 11:
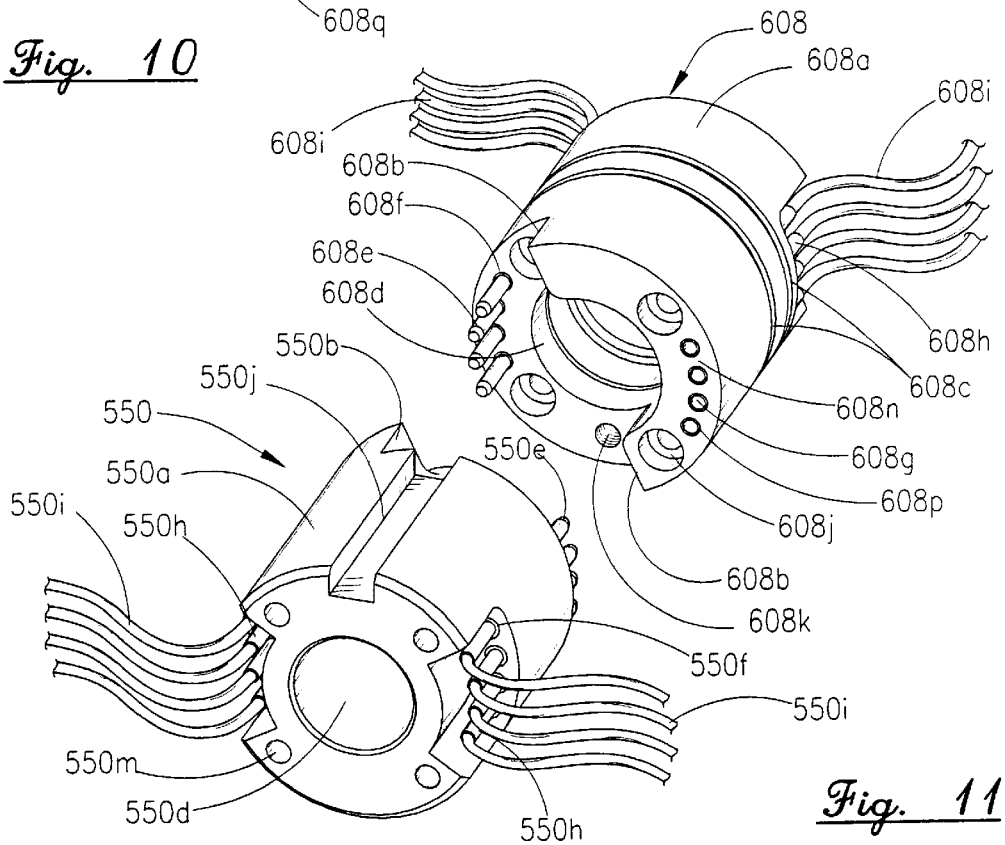
Figure 12:
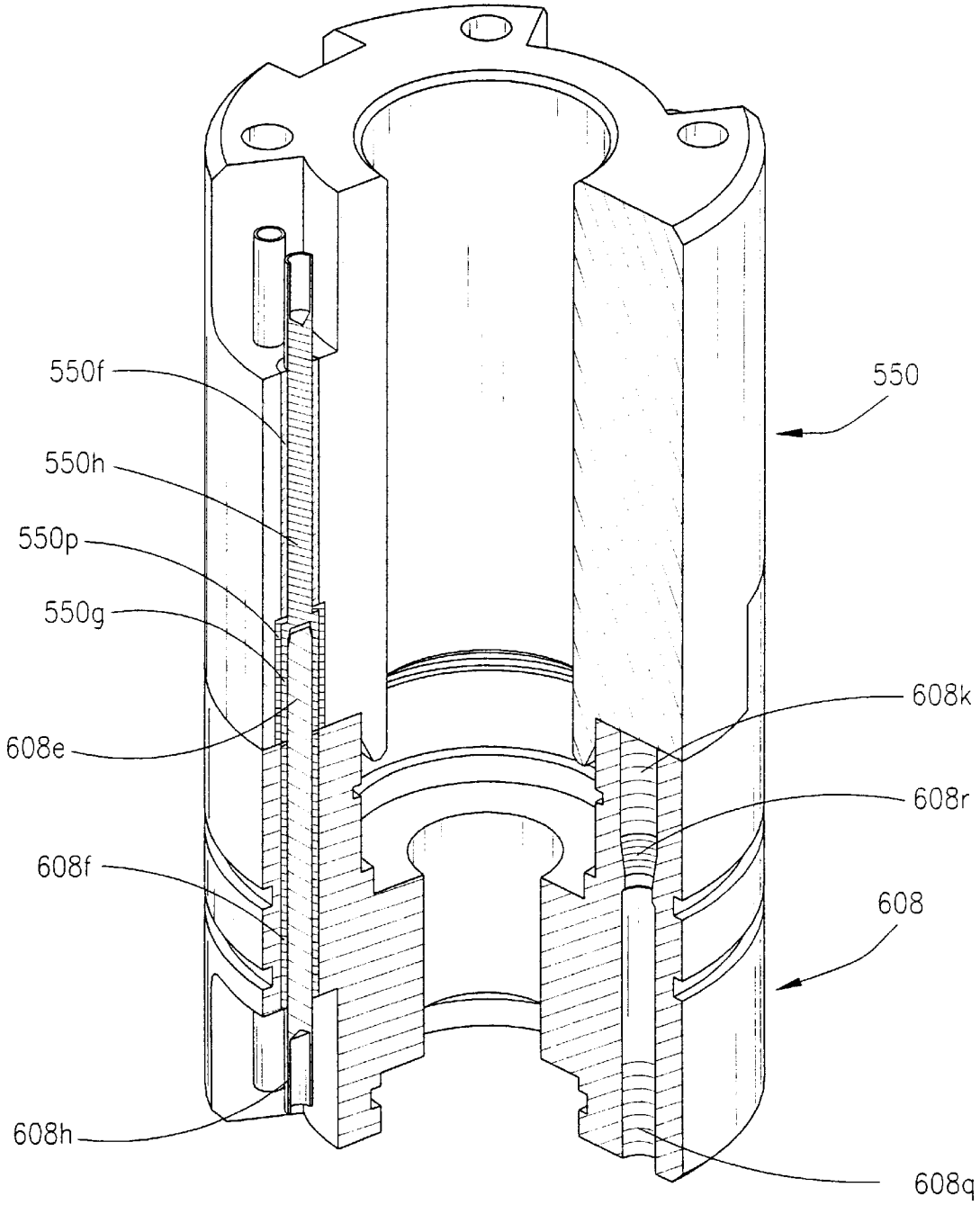
FIG. 12 is a cross-sectional view of the connectors when mated together.

Referring to FIGS. 10, 11 and 12, the connectors 550 and 608 are configured to align with each other along a common central axis in order to establish electrical continuity across the connectors and to mechanically interlock the connectors. The mechanical connection restricts rotation of the connectors 550 and 608 about the common central axis with respect to each other and keeps the connectors engaged to each other. The connectors 550 and 608 provide the means to electrically connect the turbine assembly 500 to the actuator assembly 600.

Connectors 500 and 608 each have a similar design, with the differences pointed out below. Connector 550 has an annular body 550*a* with a central passageway 550*d* through which the rotary drive of the alternator and hydraulic pump passes. The central passageway 500*d* is coaxial with the central axis of the body 550*a*.

The interlocking connection between the connectors is formed from mating surfaces of the connectors. The body 550*a* of connector 550 has a raised, annular ridge 550*n* that partially extends around the central passageway 550*d* at the end of the body 550*a*. The ridge 550*n* forms an interlocking "clam shell" connection with a corresponding ridge 608*n* of connector 608 when the two connectors are mated. The end of the connector 550 has a bullet nose 550*c* which surrounds the central passageway 550*d* of connector 550. The bullet nose 550*c* is configured to engage annular passage 608*d* of connector 608. In this manner, the two ridges interlock with each other to prevent the connectors from rotating, one with respect to the other. The bodies of the connectors are locked together so as to minimize the relative motion of the connectors. In turn this minimizes the static and vibrational loading at the pin and socket interconnects.

The ridge 608*n* has embedded electrical sockets 608*g* that are configured to mate with corresponding pins 550*e* that protrude from body 550*a* near the end of the connector 550. The pins 550*e* are parallel to the central axis of the body 550*a* and extend from a portion of the end that receives the ridge 608*n*.

The pins, 550*e* and 608*e*, and the sockets, 608*g* and 550*g*, provide the means to electrically connect wires 550*i* of the turbine assembly and wires 608*i* of the actuator assembly. To accomplish this, the connector 608 has internal conductive rods 608*h* that are embedded in the body 608*a* and extend longitudinally from end to end of the body 608*a*. The conductive rods 608*h* are eccentric to the central passageway 608*d* and are mechanically secured and electrically isolated from the body 608*a* by an outer, insulative glass seal 608*f*. The sockets 608*g* are mechanically supported by a nylon sleeve 608*p*. Small drilled holes in the opposite end of each of conductive rods 608*h* provide the means to mechanically and electrically secure wires 608*i* to conductive rods 608*h*. The wires 608*i* are soldered to conductive rods 608*h* via the drilled holes in the end of the rods.

Similar to connector 608, connector 550 has internal conductive rods 550*h* that are embedded in the body 550*a* and extend longitudinally from end to end of the body 550*a*. The conductive rods 550*h* are eccentric to the central passageway 550*d* and are mechanically secured and electrically isolated from the body 550*a* by an insulative glass seal 550*f*. Near the mating end of the body 550*a*, pins 550*e* are extensions of the conductive rods 550*h* and are adapted to mate with the sockets 608*g*. Near the other end of the body 550*a*, conductive rods 550*h* extend beyond the body 550*a*. Small drilled holes in the ends of conductive rods 550*h* provide the means to mechanically and electrically secure wires 550*i* to conductive rods 550*h*. The wires 550*i* are soldered to conductive rods 550*h* via the drilled in end of the rods.

The connector 550 also has sockets 550*g* that are configured to mate with corresponding pins 608*e* of the connector 608. The pin and socket features of the one connector parallel the pin and socket features of the other.

Among the other features of the connectors, the body 550*a* of the connector 550 has four holes 550*m* that permit the bolts to pass through the body 550*a*. The holes 550*m* are parallel and eccentric to the central passageway 550*d* of the body 550*a*. The holes 550*m* are aligned with corresponding threaded holes 546*j* of the lower weldment 546 (see FIG. 3). The body 550*a* also has a keyway 550*j* that is exposed on the outside of the body 550 and extends along the longitudinal length of the body 550. The keyway 550*j*, along with a corresponding keyway 546*g* in the lower end of weldment 546, forms a passageway for loading balls 554. Threaded hole 550*k* provides a means to secure the ball keeper 555 with the screw 556.

The body 608*a* of connector 608 has four holes 608*j* that permit bolts to pass through body 608*a*. The holes 608*j* are parallel and eccentric to the central passageway 608*d* of the body 608*a*. The holes 608*j* are aligned with corresponding threaded holes 619*a* in bracket 619 (see FIG. 9). The O-ring glands within holes 608*j* provide the means to seal the passage between the bolts and the connector body 608. The ports 608*k* and 608*q* are connected by a hole drilled through the body 608. Both ports are threaded to receive pipe fittings such as a pipe nipple or a pipe plug. Pipe plug 605 (see FIG. 6) is installed in the port 608*k* after the actuator assembly has been charged. Within the drilled hole connecting the two ports, 608*k* and 608*q*, is a gland 608*r* designed to seal the port by threadedly securing valve core 606 (see FIG. 6) in the port.

The valve core 606 and seat may be tested by threadedly attaching port 608*q* of connector 608 to a hydraulic test stand.

In some embodiments, the bodies 550*a* and 608*a* of the connectors are made of metal and in other embodiments, the bodies 550*a* and 608*a* are made of an insulative material, such as PEEK. In the embodiments where PEEK is used, the conductive rods passing through the body of the connector are sealed directly to the body of the connector. Thus, the need for the glass seals is eliminated.

Printed Circuit Board Assembly

Figure 13:
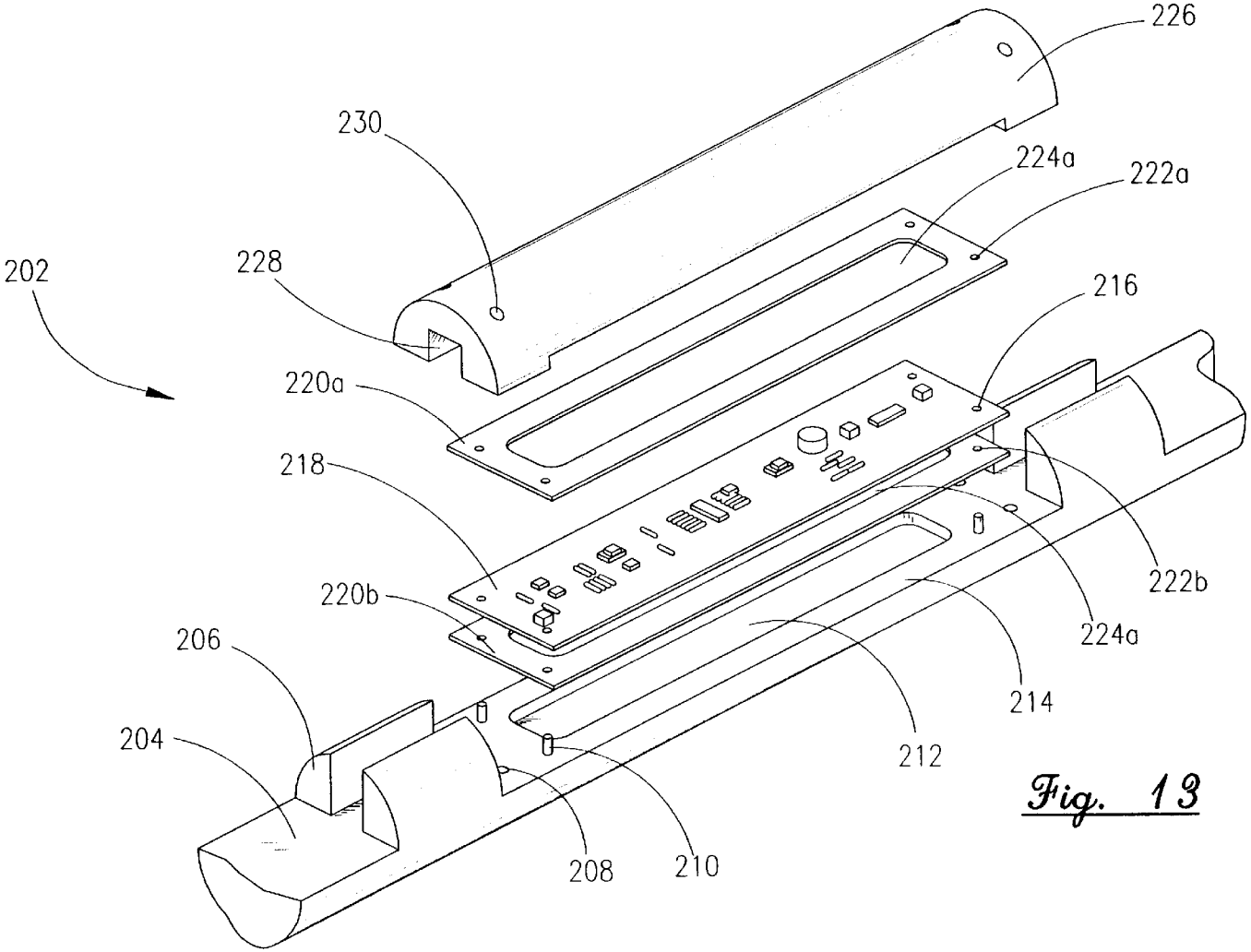
FIG. 13 is an exploded perspective view of the circuit board assembly.

Referring to FIG. 13, a printed circuit board mounting assembly 202 is adapted to mount a printed circuit board 218 on the upper surface of a section 214*a* of a chassis 204. The chassis 204 includes two sets of upstanding quarter circular sections 206 which define between them a generally flat region 214 for receiving the printed circuit board 218. A plurality of upstanding guides 210 extend from the four corners of the region 214 to guide the printed circuit board into position on the surface 214. In addition, a plurality of screw holes 208 are adapted to receive screws (not shown).

A pair of electrical insulators 220*a* and 220*b* sandwich printed circuit board 218. The lower insulator 220*b* is a continuous sheet of insulating material such as Teflon® with a plurality of apertures 222*b* alignable with apertures 216 in printed circuit board 218. Similarly, the insulator 220*a* includes apertures 222*a* which mate with the apertures 222*b* and 218 in the insulator 220*b* and the printed circuit board 218, respectively. Insulators 222*a* and 222*b* include an openings 224*a* and 224*b* to accommodate any electrical components which extend outwardly from the surface of the printed circuit board 218. A semicircular cover 226 includes a plurality of screw holes 230 which mate with the holes 208 in surface 214. In addition, an opening 228 is provided to permit electrical wires to feed between the elements 206 and onto the printed circuit board 216.

When the assembly 202 is made up, the elements 220*a*, 218, and 220*b* are sandwiched on top of the surface 214 held in alignment by the upstanding pins 210. The whole assembly is sandwiched onto the surface 214 by the cover 226 which is threadedly connected by screws (not shown) to the surface 214. In this way, the printed circuit board 218 is uniformly clamped around its peripheral edge to the chassis 204. This peripheral clamping of the printed circuit board 218 serves to shift the mechanical modes of vibration of the printed circuit board and the components attached to the board to a higher frequency, into a frequency range where the energy available to excite the resonant modes of the printed circuit board and components is substantially reduced. Thus, the clamping of the printed circuit board reduces the effect of mechanical vibration which otherwise causes damage to the printed circuit board, solder joints and electrical components attached to the printed circuit board. Clamping the printed circuit board 216 serve to increase the useful life of the printed circuit board 216 and the components mounted thereon.

MWD Tool Assembly

Figure 14:
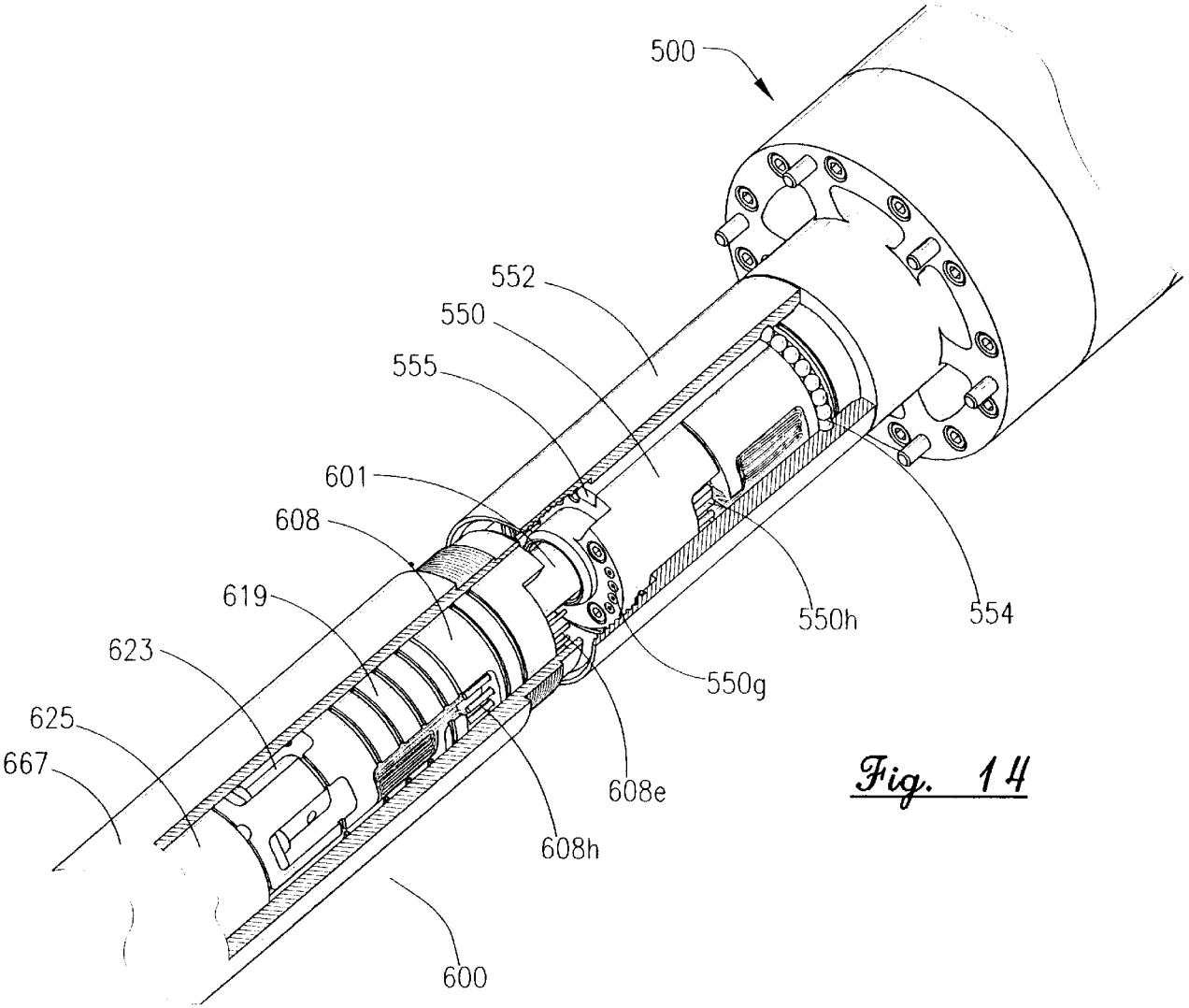
FIG. 14 is a schematic view illustrating connection of the actuator and turbine assemblies.

As stated above, the turbine assembly 500 and actuator assembly 600 are designed to couple together mechanically and electrically. Referring to FIG. 14 As turbine assembly 500 is coupled to actuator assembly 600 the splined end of shaft 539 first engages the matching splined coupling 601. Then, the connector 550 on the lower end of turbine assembly 500 engages the connector 608 on the upper end of actuator assembly 600. As connector sleeve 552 is threaded onto the pressure housing the two connectors, 550 and 608, are pulled together, and the pins 550*e* (608*e*) engage the sockets of 608*g* (550*g*). Continuing to thread connector sleeve 552 onto the pressure housing, the nose 550*d* of connector 550 engages the opening 608*d* of connector 608.

Referring to FIGS. 3 and 4, to charge the turbine assembly 500 with hydraulic fluid, the assembly 500 is placed in a vertical position and filled with hydraulic fluid via a port 514*a* of the upper weldment 512. As hydraulic fluid is introduced into the system, the fluid displaces air trapped inside the assembly 500. This displaced air exits the assembly 500 through another port 514*a* (not shown) in the upper weldment 512. Once the air is substantially displaced, as evidenced by a flow of hydraulic fluid, a valve core 514 (e.g., a Shrader valve core) is installed in each of the ports 514*a* of the upper weldment 512. A plug 515 is then installed in one of the ports 514*a* above the valve core 514, and the hydraulic charging tool is attached to the other port 514*a* to charge the accumulator in the assembly 500 to a predetermined pressure (e.g., 100 p.s.i.). The charging tool is then removed from the port 514*a*, and a plug 515 is then installed in this port 514*a* to seal the assembly 500.

The assembly including the interface assembly 400, turbine assembly 500, actuator assembly 600 and outer valve sleeve 701 is threadedly attached to the lower end of lug 663 and is installed in pulser collar 4. The entire assembly slides into pulser collar 4 and the dowel pins 548 of the turbine assembly 500 are made to engage the mating ports 4*c* that are formed in the shelf 4*a*. Besides holding the turbine assembly 500, the shelf 4*a* also prevents the bolts 549 of the assembly 500 from backing out. Per the alignment procedure discussed above, the inner valve 703 is inserted through the open end of outer valve sleeve 701 and the inner valve 703 is aligned with respect to the outer sleeve 701.

The valve collar 5 slides over the outer valve sleeve 701 on the lower end of the assembly, and the valve collar 5 is threadedly attached to the lower end of pulser collar 4. The inner valve sleeve 703, spacer sleeve 706 and the entire pulser assembly are secured by a nut 707, which is made up to the lower end of outer valve sleeve 701. The set screws 708 prevent nut 707 from backing off while the MWD tool assembly 1 is in service.

The assembly of the MWD tool assembly 1 is continued by attaching bull plug 110, rubber fin centralizer 300*a*, survey measurement assembly 200 and rubber fin centralizer 300*b* to the upper end of the pulser assembly (which is the upper end of the interface assembly 400). The cross over sub 3 and the non-magnetic drill collar 2 slide over the upper end of pulser assembly and are threadedly attached to the upper end of pulser collar 4.

Other embodiments are within the scope of the following claims.

What is claimed is:

1. A method for charging a hydraulic system for a mud pulse generator, wherein the hydraulic system is located in a pressure housing of a downhole tool and hydraulic fluid is supplied through a one way inlet valve to a reservoir of said system, said method comprising:

submerging the hydraulic system in a tank of hydraulic fluid;

applying a vacuum to the fluid to remove air from the hydraulic system;

releasing the vacuum; and mounting, the pressure housing over the hydraulic system while the system remains submerged.

2. A method for charging a hydraulic system for a mud pulse generator, said method comprising:

a supplying hydraulic fluid under pressure through a one way inlet valve to a reservoir of said system;

maintaining the hydraulic system in one discrete assembly, said discrete assembly being part of a downhole tool having at least one other discrete assembly; and charging said hydraulic system before connecting the discrete assemblies together.

3. A downhole tool for use in a high pressure environment in a subterranean well, the tool comprising:

a tool housing having a diameter sufficiently small to allow said housing to be positioned downhole in a subterranean well;

an accumulator positioned within said housing and having a reservoir for storing hydraulic fluid; and an actuator positioned within said housing, and having a shaft with a passageway adapted to establish pressure communication between the reservoir and the high pressure environment.

4. The downhole tool of claim 3, wherein the high pressure environment comprises hydrostatic pressure of a drilling fluid.

5. The downhole tool of claim 3, further comprising a gasket adapted to form a seal between the housing and the actuator, wherein the communication established by the passageway minimizes a pressure difference across the seal.

6. The downhole tool of claim 3, wherein the actuator comprises a rotary actuator.

7. A method for use with a downhole tool having an accumulator, the accumulator having a reservoir with hydraulic fluid and a piston, the piston having a position indicative of a pressure level of the hydraulic fluid, comprising:

determining the position of the piston; and based on the position, determining the pressure level of the hydraulic fluid.

8. The method of claim 7, wherein the tool has an actuator having a shaft with a passageway adapted to establish communication between the reservoir and an area surrounding the tool, the step of determining the position of the piston including:

from outside of the tool, inserting a rod into the passageway a distance to contact the piston; and determining the position based on the distance.

9. A downhole tool for use in a high pressure environment in a subterranean well, said tool comprising:

a rotary actuator;

a hydraulic valve fluidly connected to said rotary actuator;

a pressure relief valve fluidly connected to said hydraulic valve;

a pump fluidly connected to said hydraulic valve; and a reservoir fluidly connected to said hydraulic valve.

10. The downhole tool for use in a subterranean well according to claim 9, wherein said tool is enclosed in a tool housing having a diameter sufficiently small to allow said housing to be positioned downhole within a subterranean well.

11. The downhole tool for use in a subterranean well according to claim 9, wherein said hydraulic valve is a multiple position spool valve.

12. The downhole tool for use in a subterranean well according to claim 11, wherein said hydraulic valve is a three position, four way tandem valve.

13. The downhole tool for use in a subterranean well according to claim 11, wherein said hydraulic valve is a solenoid activated valve.

14. The downhole tool for use in a subterranean well according to claim 9, wherein said rotary actuator has multiple fluid inlet ports such that applying fluid pressure to different inlet ports results in said actuator assuming different rotative states.

15. The downhole tool for use in a subterranean well according to claim 9, wherein said reservoir is an accumulator providing a net pressure with respect to a hydrostatic pressure exerted by a column of drilling fluid.

16. A downhole tool for use in a high pressure environment in a subterranean well, said tool comprising:

a mud valve having an open and closed position;

a rotary actuator attached to said mud valve and moving said mud valve between said open an closed positions through rotary motion; and a hydraulic valve attached to said rotary actuator whereby hydraulic pressure from said valve rotates said rotary actuator.

17. The downhole tool for use in a subterranean well according to claim 16, wherein said hydraulic valve is a solenoid activated spool valve.

18. The downhole tool for use in a subterranean well according to claim 17, wherein a pressure relief valve and a fluid reservior are fluidly connected to said hydraulic valve.

19. The downhole tool for use in a subterranean well according to claim 18, wherein said fluid reservoir includes an accumulator.

20. The downhole tool for use in a subterranean well according to claim 18, wherein said reservoir is an accumulator providing a net pressure with respect to a hydrostatic pressure exerted by a column of drilling fluid.

21. The downhole tool for use in a subterranean well according to claim 16, wherein said mud valve includes an inner cylinder positioned within an outer cylinder.

22. The downhole tool for use in a subterranean well according to claim 16, wherein said tool is enclosed in a tool housing having a diameter sufficiently small to allow said housing to be positioned downhole within a subterranean well.

23. The downhole tool for use in a subterranean well according to claim 16, wherein said hydraulic valve is a multiple position spool valve.

24. The downhole tool for use in a subterranean well according to claim 16, wherein said hydraulic valve is a three position, four way tandem valve.

25. The downhole tool for use in a subterranean well according to claim 16, wherein said hydraulic valve is a solenoid activated valve.

26. The downhole tool for use in a subterranean well according to claim 16, wherein said rotary actuator has multiple fluid inlet ports such that applying fluid pressure to different inlet ports results in said actuator assuming different rotative states.

* * * * *